United States Patent [19]

Whitacre

[11] 3,969,851

[45] July 20, 1976

[54] ARCHITECTURAL PAVING SYSTEM WITH INDIVIDUAL CONTROL JOINT PAVING

[75] Inventor: Daniel C. Whitacre, Massillon, Ohio

[73] Assignee: Structural Stoneware Incorporated, Minerva, Ohio

[22] Filed: July 11, 1975

[21] Appl. No.: 595,026

[52] U.S. Cl. ..... 52/98; 52/390; 52/746; 52/747; 404/17; 404/82

[51] Int. Cl.[2] ..... E04C 1/28; E01C 7/00

[58] Field of Search ..... 52/384–392, 52/169, 573, 346, 347, 396, 98–100, 746, 747; 404/27, 47, 48, 82, 29, 34, 89, 31, 99, 17, 87

[56] References Cited

UNITED STATES PATENTS

| | | | |
|---|---|---|---|
| 312,897 | 2/1885 | Rapp | 404/47 |
| 1,029,575 | 6/1912 | Blome et al. | 404/82 |
| 1,173,678 | 2/1916 | Munro | 52/384 |
| 2,119,804 | 6/1938 | Crooks | 52/392 |
| 3,515,611 | 6/1970 | Muhlberg et al. | 52/390 |

FOREIGN PATENTS OR APPLICATIONS

| | | | |
|---|---|---|---|
| 12,152 | 4/1933 | Australia | 404/17 |
| 233,048 | 1/1961 | Australia | 52/396 |

*Primary Examiner*—James L. Ridgill, Jr.
*Attorney, Agent, or Firm*—Bosworth, Sesions & McCoy

[57] ABSTRACT

Architectural or decorative pavement having thin decorative pavers or "tiles" made of or selected from known materials, from metal and impregnated wood to natural stone to clay or cementitious tiles, are bonded to the upper surface of a sand and cement (and latex, if desired) setting bed before the bed takes its initial set. "Thin" pavers are less than ¼ inches thick. Stronger materials in these pavers lend themselves to minimum thickness in small to medium sizes. Thin pavers of weaker materials require maximum thickness in large to medium sizes.

The pavers are placed in rows and designs as may be pleasing with adjacent side edges spaced apart and forming gaps all around the perimeter of each paver.

While the bed and bond are both green, vertical cuts are made through and below the gaps and through the bond coat and appreciably into the setting bed all around the whole perimeter of each paver. The setting beds are supported on appropriate bases or other supporting means.

After the paving is cured the cuts in the setting bed create a stress line below which destructive forces exerted on the finished pavement are concentrated to vertical downward extensions of the cuts to the full depth of the bed, and form, in effect, whole, separate, monolithic fractured-out pavement blocks which may suffer bodily displacement while preserving the integrated pavers whole and intact.

The cuts into the setting bed, or the cuts and subjacent cracks, comprise by their numbers and proximity, expansion and control joints.

7 Claims, 6 Drawing Figures

FIG. 1
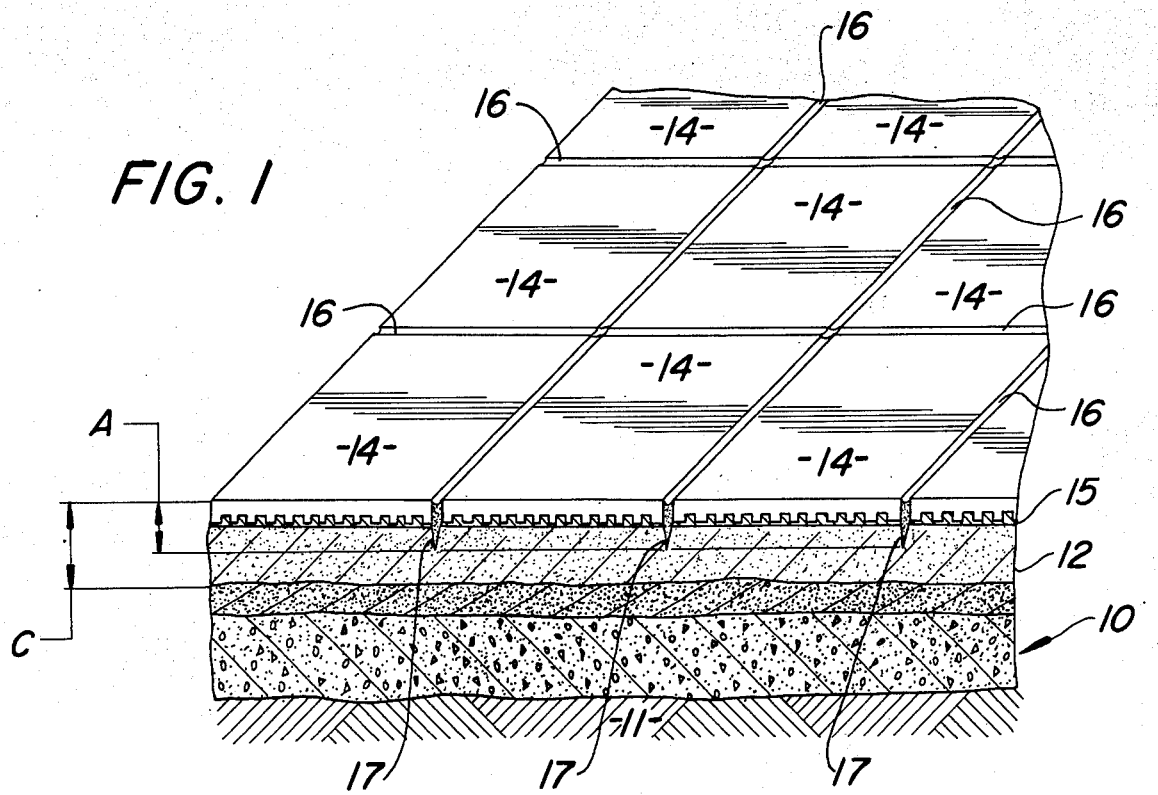
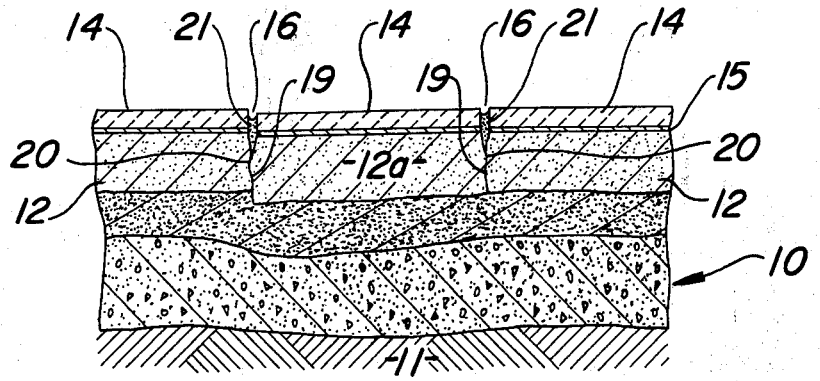
FIG. 2

FIG. 3
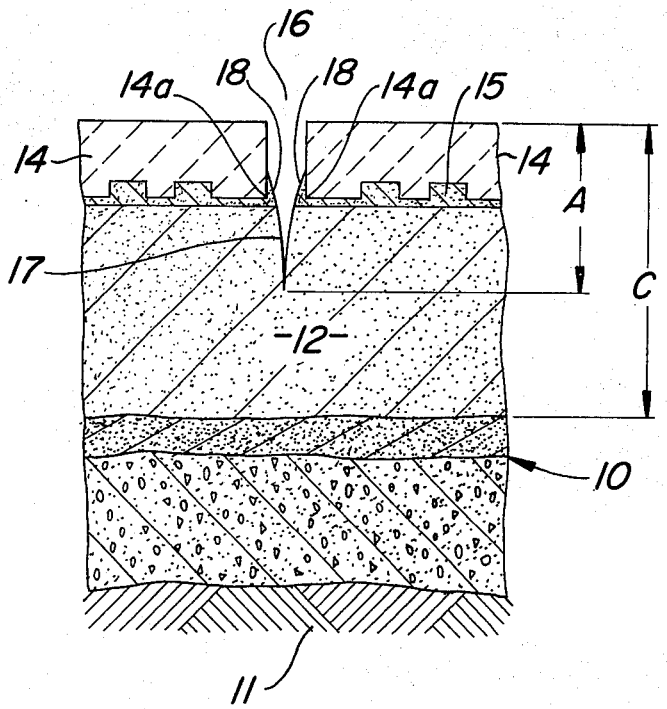
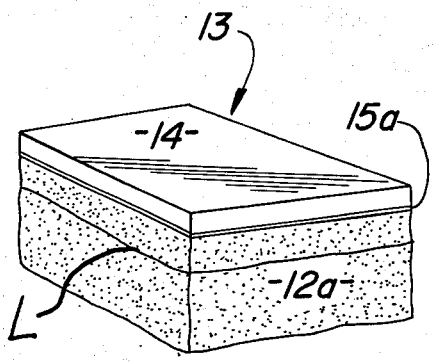
FIG. 4
FIG. 5
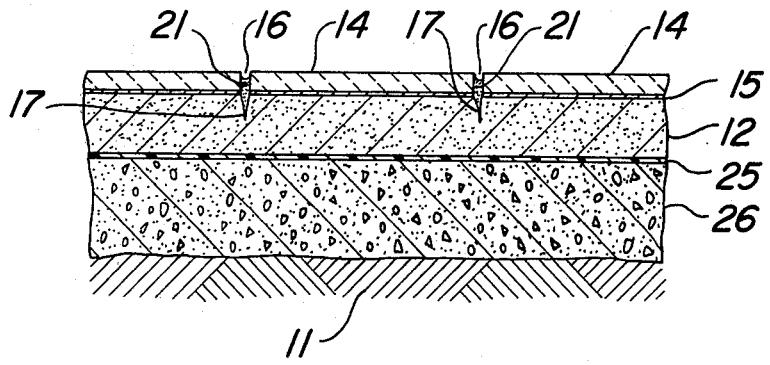
FIG. 6
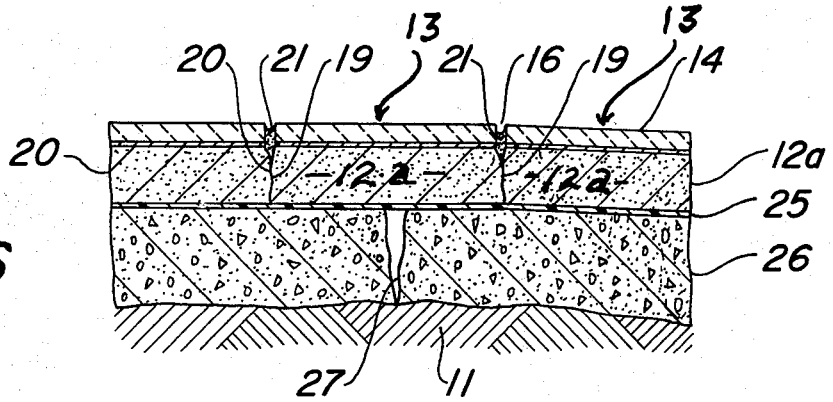

ARCHITECTURAL PAVING SYSTEM WITH INDIVIDUAL CONTROL JOINT PAVING

BACKGROUND OF THE INVENTION

This invention relates to exterior pavements and in more particular to exterior architectural pavements or paving systems which are decorative as well as functional.

Architectural exterior pavements or paving systems are, generally speaking, those which are intended to present a pleasing and/or decorative visible surface. Architectural pavements are expected to carry pedestrian traffic and light vehicular traffic and, on occasion, have to support heavier vehicular traffic as well as endure or survive other forces ranging from freezing and thawing to earthquakes and tremors. Examples of such pavements have been used as walkways, courtyards, malls, streets, gardens, patios and/or the wearing or decorative surfaces of a building roof or deck. The decorative appearance of known architectural pavement is provided by the topmost layer of paving elements (hereinafter, pavers) which are usually rectangular or polygonal blocks such as clay tile, concrete, slate, stone, impregnated wood or other materials that provide a decorative but sturdy wearing surface and can be arranged in a decorative or aesthetically pleasing pattern.

Pavers are usually supported at the bottom by, variously, a sub-base of natural earth or compacted earth, a base which usually rests upon a sub-base and may be either rigid or somewhat yielding compared with the sub-base, and a setting bed laid on the base and supporting the pavers. A base usually comprises compacted stone or gravel, or compacted sand or compacted sand and gravel, asphalt, concrete, prior pavement or the load bearing aspect of a roof deck.

Two prior methods have been commonly employed for laying pavers on a base. The first is to lay desirably thin pavers and a setting bed on a rigid base, such as reinforced concrete, and then grout the joints between pavers so that the entire system is rigid. Problems with this arrangement arise, however, due to forces exerted from above, such as heavy vehicles, or exerted vertically from below as by sub-base instability, quakes or tremors, or horizontally by movement due to thermal or moisture expansion and contraction, which tends to cause the pavers, setting bed and/or the base to crack at random and monolithically.

A second procedure requires the use of relatively thick pavers (1-¼ to about 4-½ inches thick) which are placed on or laid on a bed or base of sand, asphalt or the like which permits each individual paver to "float". Movement will then occur between pavers rather than through them. This method, however, requires the use of relatively thick pavers which have the necessary strength to prevent breaking under foot, under vehicular loading or other adverse forces mentioned above. Thick paver systems are, however, relatively expensive compared with so-called "thin" systems which employ pavers from about ⅛ inch thick for metal and from about ⅜ inch thick for other strong pavers, to about 1-1/4 inches thick for weak pavers made of asphalt or limestone, for example. With such prior thin pavers, setting beds of slightly less than one inch to about two inches in thickness have been employed. Thick paver systems offer no decorative advantage over thin paver systems.

SUMMARY OF THE INVENTION

A general object of this invention is to provide an architectural paving system and a method of architectural paving which overcomes the disadvantages, noted above, of prior systems and methods.

A more particular object is to provide a novel paving system and method wherein thin pavers may be employed and preserved against cracking where used over a base or sub-base that is somewhat yielding and/or caused to yield under adverse forces.

Another object is to minimize or eliminate the need for expansion joints when using thin pavers.

Another object is to gain the advantages of the use of thick pavers by and with the use of thin pavers.

Another object is to provide a paving system and method which permits the use of thinner paving sections of relatively light weight for a decorative roof deck without increasing the danger of cracking of the decorative surface.

Another object is to provide a paving system employing thin pavers, especially useful for a roof deck or the like, which can facilitate removal and/or replacement and repair of a leak in a roof membrane.

Another object is to provide a paving system with thin pavers which can facilitate removal and/or replacement and repair of underlying pipes, conduits and the like.

Another object is to provide a thin paver, paving system of pleasing appearance with straight joint alignment and useful spacing between pavers suitably filled.

Other objects and advantages of the invention will appear from the following description of preferred and modified forms and embodiments of my invention.

BRIEF DESCRIPTION OF THE DRAWINGS

FIG. 1 is a fragmentary isometric view of newly made pavement embodying my invention taken in a vertical plane proximate the near ends of pavers supported on the sectioned subjacent structure.

FIG. 2 is a fragmentary vertical cross-section of both the pavers and subjacent structure shown in FIG. 1 after the pavement has been used and after the setting bed has been cracked; the middle paver and the middle "integral" subjacent part of the setting bed having been displaced relative to adjacent corresponding portions of the pavement.

FIG. 3 is an enlarged fragmentary vertical section similar to FIG. 1 showing the cut made through and below the gap between pavers, through the bond coat and into the green setting bed.

FIG. 4 is an isometric view of the monolithic block of paver bonded to the fractured-out subjacent part of a setting bed seen as if detached from a fractured pavement such as the middle of FIG. 2

FIG. 5 is a fragmentary section taken through pavers, and newly laid pavement similar to FIG. 1, showing a form of my invention in which the base comprises strong, solid concrete, as in a prior highway with a bond preventing sheet or element interposed between the base and the setting bed.

FIG. 6 is a view similar to FIG. 5 taken however after the base has been stressed to the point of fracture and the pavers and subjacent parts of the setting bed fractured out into separate monolithic paving blocks as shown in FIG. 4.

DESCRIPTION OF PREFERRED EMBODIMENTS

Referring now to the drawings, and initially to FIGS. 1 and 2, an architectural pavement embodying my invention is shown applied over a somewhat yielding, compacted sand and compacted stone or gravel, or the like, base 10. It should be noted that an architectural pavement embodying my invention may also be applied over substantially any base incuding reinforced or unreinforced concrete, asphalt, sand, compacted sand or gravel and roofing membrane or substantially any known or convenient material commonly employed as a base for architectural paving. The sub-base 11 as I refer to it herein, may comprise earth or compacted earth when speaking of pavements on earth, assuming no sub-base as such will be present in a roof structure to support a roofing membrane.

The architectural pavement of FIGS. 1 and 2 includes a sand-cement setting bed 12 which is laid over base 10. The base has a thickness and strength appropriate for the load, environment and use of any particular installation. The setting bed 12 may be a conventional Portland 3 to 1 sand-cement mixture and may include latex when appropriate as is understood in the art. Pavers 14 are placed on setting bed 12 while it is green, i.e., before it takes its initial set, and the pavers are bonded thereto by means of a bond coat 15. Bond coat 15 may be a rich 1 to 1 sand-cement plus latex, mixture or a suitable commercial thin-set bonding material. The bond coat 15 may be applied to the top surface of the setting bed 12 before it takes its initial set. Alternatively and preferably, the bond coat 15 is applied to the paver just prior to placing the paver on the green bed. Adjacent pavers are spaced apart by gaps 16.

Before setting bed 12 takes its initial set, I cause cuts 17 to be made between adjacent pavers 14 into the setting bed 12 to a depth A, FIGS. 1 and 3 measured from the top surface of the pavers to the bottoms of the cuts. FIG. 3 is an enlarged view of cut 17 wherein the effect of cutting through bond coat 15 is also shown. The material of the bond coat is severed, forced aside and upwardly as at 18 and improves the bond and seal at the lower opposite edges 14a of the pavers.

The combined depth A of the pavers, bond coat and cut is preferably not less than about one-third of the depth C from the top surface of the paver to the bottom of the bed 12. Should the thickness of the paver alone equal or exceed about ⅓ of the depth C in any instance, I prefer to make a significant cut through the bond coat and into the setting bed in any event. This insures that the gap 16 between adjacent vertical paver faces is not wholly or partially filled with bond coat material, on the one hand, and that the upper part of the setting bed is cut or scored to an appreciable depth below the bottom of the pavers and bond coat, even down to the bottom of the setting bed 12, on the other hand.

The function and accomplishment of the cuts 17 is to prevent cracking of the pavers by confining cracking and fractures to cracks 19 in the setting bed, FIGS. 2 and 6. Cracks 19 comprise downward extensions of parametric continuities of cuts 17 below gaps 16 all around the downward projections of the side edges of each paver and from the lower side faces of fractured-out blocks 13, FIGS. 2, 4 and 6. Otherwise cracking stress tends to fracture the pavers and the subjacent setting bed indiscriminately.

As suggested in FIGS. 2, 4 and 6, the preservation of the thin pavers 14 is done by integration of respective subjacent parts **12*a* of the setting bed and respective subjacent parts 15a of the bond coat with each paver 14 to form thick, strong, composite monolithic blocks 13. These blocks after being fractured in situ and from the bed or beds 12 are supported from below in the then altered base, sub-base or roof or deck structure or element upon which the green setting bed was originally placed and leveled. The fractured-out blocks 13 also have mutual lateral support with tight mechanical and frictional engagement with laterally adjacent blocks, or the adjacent up-and-down face or faces of the original unfractured and therefore originally unstressed aspect of setting bed 12 as suggested at 20 in FIGS. 2 and 6. The preserved pavers on the fractured-out blocks 13** supported as mentioned above, tend to be displaced so little from their original pattern and disposition as to fairly preserve the pattern and pleasing effect of the original paved surface.

Referring back to FIG. 3 and the depth of the cut 17, the foregoing will reflect my present experience and understanding: When the cut is significantly deeper than my preference about A in reference to C, FIGS. 1 and 3, the excessive depth may be more costly in time and effort without commensurate advantage. Should the cut by virture of depth and/or width cause the fractured-out blocks 13 to lack mutually beneficent lateral support, the strength, firmness or appearance of the whole fractured pavement many tend to be impaired.

In FIG. 4, the not necessarily sharp line L suggests that the parametric exterior surface of the block 13 above the line is smoother than that below the line because the former was smoothed by the cutting tool while the latter resulted from the fracture which created the block. I have found that knives similar to linoleum knives, having points curved at about right angles to the shank and with an arcuate cutting edge facing the handle, facilitate making a full cut where the groove through which the blade is drawn terminates opposite the side of an adjacent paver as when pavers are laid in an overlapping pattern or "running bond" not as shown in FIG. 1. Cutters with rotatable blades similar to the familiar lawn edging tools have advantage when the gaps 16 between adjacent pavers are aligned as shown in FIG. 1 to form continuous elongated grooves through which the cuts 17 are made. The width of the gaps 16 are preferably no smaller than ¼ inch as with 8 × 8 inches or smaller pavers of ⅛ to 1 inch thickness. Greater gaps with larger and/or thicker pavers or non-rectangular patterns function within the teachings of my invention.

The size and/or the maximum horizontal dimension of a preferred form of a paver used in my invention depends on a number of interrelated factors.

Aesthetic values suggest that the size of a paver and/or the relative sizes, shapes and arrangement of different pavers, relate pleasantly to the size and shape of the paved area where it is employed and to the design or pattern of the pavement. In a curved walkway three feet wide, pavers one foot square would in my present view be less desirable than 6 × 6 inches or 4 × 8 inches pavers, for example. Large open areas invite patterns involving pavers of different sizes and shapes to break the monotony of repetition.

Economy pertaining to the cost of making and laying the pavers is important. A paver is related to the size of a human hand much as a common or decorative brick is so related. The brick is held in one hand while mortar is applied by trowel with the other. I prefer that my pavers be grooved or scored on their bottom sides to receive a bonding coat before being laid on a setting bed. Holding the paver in one hand facilitates applying the bond coat with the other. Thin pavers 4 × 8 inches, 6 × 6 inches, 8 × 8 inches, 8 × 16 inches, even 12 × 12 inches are easily handled. Smaller pavers while more easily handled, require more bonding and setting motions and alignments and may take more time to select and lay per unit of area than larger and more uniform pavers. Generally, small pavers cost more to make, as well as lay, per unit of area.

While square and rectangular pavers are suggested in the drawings herein, hexagonal and octagonal shapes in well known patterns are well adapted to use with my invention.

Transporting pavers from their place of manufacture to the place of use suggests that "thin" pavers of my preference made of frangible material will survive if small, better than large.

My invention facilitates a wide choice of pavers as to material, size of surface area and as to thickness. Pavers between about ⅛ to 1-¼ inches are called thin pavers herein. My invention in its preferred form so integrates and isolates each paver with its subjacent coextensive part of the setting bed, that thin, large-in-area and structurally weak pavers may be employed with little or no hazard of cracking the pavers or the showing of unsightly cracks in the whole paved area. For example, my thin pavers may be made or selected from known material such as cast, wrought or extruded metal, slate, granite, fired clay, concrete, precast terrazzo tile, impregnated wood and/or asphalt tile.

Generally speaking the stronger materials such as metal, granite, fired clay and impregnated wood may be employed advantageously in pieces as thin as ⅛ to 3/16 inch for metal and ½ inch for other strong pavers in area-size up to about 8 × 8 inches. In area size of about 12 × 12 inches or 8 × 16 inches a thickness about 3/16 to ¼ inch for metal and ⅝ to ¾ inch for other strong materials is presently preferred. Weaker materials such as limestone, concrete, terrazzo tile and asphalt tile should, as I presently prefer, be made in area sizes up to about 8 × 8 inches by about ¾ inch in thickness. In area sizes of about 12 × 12 inches or 8 × 16 inches, I prefer the thickness be about 1 to 1-¼ inches for the satisfactory practice of my invention. Impregnated wood is a known commercial product of enhanced strength formed, as I believe, by treating wood to near vacuum pressure, then impregnating it with methylmethacrylate and finally subjecting the impregnated wood to cobalt radiation.

The form of my invention shown in FIGS. 5 and 6 employs the same or substantially the same pavers 14, setting bed 12, bond 15 therebetween, gaps 16 and cuts 17 which have the same or substantially and essentially the same functions, modes of operation and results as described in reference to FIG. 1. This paver and cut-setting bed combination is related to the rigid concrete base 26 somewhat differently than is the same paver-setting bed related to the base 10 in FIGS. 1 and 2.

In the FIGS. 5–6 form, a slip sheet 25 is placed on the base 26 and the setting bed is laid on the sheet 25 and supported on the base through the sheet. The office and function of the slip sheet is to prevent the bed 12 from bonding with or adhering to the rigid base 26. Otherwise, as I am presently advised, the function and operation of the cuts 17 and the controlled fracture-out of blocks 13, FIG. 4, would be lost or impaired. The sheets or slip sheets 25 may comprise tar paper, roofing paper or polyethylene film, for example; the sheets being tough and rugged enough to prevent adherence or bonding between the setting bed and the base. That is to say the sheet 25 will permit bed 12 and/or fractured-out blocks 13 to slip with respect to the base 26 when adverse forces and stresses buckle or break the base as at 27 and induce cracks 19 in the setting bed as suggested in FIG. 6. In FIG. 6, two fractured-out blocks 13 with portions 12a of the bed 12 are shown.

A few more examples of particular types of paving systems and pavements using and embodying my invention may help show its scope, utility and adaptability. In all instances, as above, the combination of pavers bonded to the setting bed, and/or to portions of the bed embraced, or to be embraced in fractured-out blocks persists. Variations between examples and the reasons therefore will be understood without additional drawings. In the following examples, all the pavers may be assumed to have about an 8 inches maximum horizontal dimension and may be square, rectangular, hexagonal or octagonal; the latter employing conventional, smaller, square pavers in the areas where the edges of contiguous octagons are not parallel or proximate.

Example 1

A residential backyard patio built on a compacted earth sub-base, a 4 inch base of sand compacted upon the sub-base, a setting bed laid on the base with exposed-aggregate decorative pavers ⅝ inch thick bonded to the bed. In this instance the total depth C of paver, bond and bed is about 2 inches, and the depth A of the cut between pavers measured from the top surface of the pavers is about 1 to 1-¼ inches.

EXAMPLE 2

A paving system over an existing asphalt street as one finds in downtown metropolitan areas being converted to malls for pedestrian and limited vehicular use. Here the sub-base may be original concrete or brick pavement, the base, a superposed asphalt pavement which carried my ½ inch thick granite paver bonded onto the top of a setting bed with a depth C of 2-½ to 3 inches and the depth A from the top of the paver to the bottom of the cut not less than about 1-¼ inches.

Example 3

A decorative paving improvement for a worn and/or seedy looking concrete or similar sidewalk essentially for pedestrian traffic. Here a 4 mill polyethylene slip sheet, or a single layer tar paper sheet, is placed over the sidewalk, my setting bed laid on the sheet and ½ inch thick impregnated wood pavers bonded to the bed. Here my preferred depth C of bed, bond and paver is 1-¼ inches and the preferred depth A to the bottom of of the cuts is ⅝ inch.

Example 4

A roof deck having a decorative and durable surface of slate pavers about ⅜ inch thick upon which people and outdoor furniture comprise a normal minimum load. In this case a load bearing structural slab underlies and provides support for the superposed parts and elements up to and including the pavers. Insulation may be laid upon the structural slab and built-up roofing including the roof membrane is disposed on and/or above the insulation. Over the built-up roof I prefer to lay protective hard protective board about ¼ inch thick to minimize danger of puncturing the built-up roofing during installation of my paver system. My setting bed is then laid on the protective board to a minimum depth of about 1-½ inches and to such greater reasonable depths as are advisable to effect a level paver surface over a sloping or uneven deck or roofing. My pavers are bonded to the green bed and cuts are made around the pavers according to my teaching above. The minimum depth C will be about 2 inches and the depth A from the top surface of the pavers to the bottom of the cuts will be no less than about ⅝ inch.

In the several forms of my invention illustrated and disclosed above, I prefer to "finish" the decorative surface after the setting bed has set and cured for 24 to 72 hours by spreading a dry joint filler 21, preferably comprising 10 parts bagged silica sand well mixed with 1 part cement colored in appropriate contrast or harmony with the pavers, over the whole paved surface and gaps 16, and then brushing the filler over the pavers and gaps until all the gaps 16 and cuts 17 are filled. Thereafter the dry filler mixture is brushed off the surface by brushing at about 45° to the line of the gaps until the level of filler in the gaps is lowered to about ¼ inch below the surface of the pavers.

After the surplus filler has been brushed aside as aforesaid, a fine water mist is sprayed evenly over the entire paved surface just sufficiently to wet the joint filler in the gaps. Excess water, and puddles, if any, is/are squeegeed off the pavement and the job allowed to dry overnight. A day or so later the whole surface is dressed with boiled linseed oil taking care to saturate the filler, sometimes called joint filler, in the gaps. Excess dressing is wiped off after 20–30 minutes.

In the finished pavement the gaps 16 and cuts 17 are filled with discrete particles in gentle mutual adhesion and filled in the sense that foreign matter is excluded albeit the filler has no significant structural strength capable of transmitting deleterious force from one paver to another. The filler may also perform a structural function in the event of a fracture in the setting bed which opens one or more of the cracks 19 enough to permit and invite grains of filler to fall and/or flow down into the crack. Grains of filler, whether few or many tend to enhance the bond or grip between fractured-out blocks 13 and between such blocks and adjacent unbroken parts of the setting bed.

While I have illustrated and described preferred and modified forms and practices of my invention, changes, and improvements will occur to those skilled in the art which are within the essential principles and teachings hereof. Therefore I do not want my patent to be limited to the specific forms and examples stated herein nor in any manner inconsistent with the progress in the art which has been promoted by my invention.

What is claimed is:

1. In an architectural paving system the combination of a setting bed laid wet upon and supported by a base without becoming firmly attached to said base when the bed has finally set, thin architectural pavers laid on the top of said bed, an adhesive bond coat interposed between the top of said bed and the bottoms of said pavers while the bed is green, said coat firmly attaching said pavers to said bed when the bed has finally set, said pavers being arranged on said bed in patterns as desired and spaced from each other with gaps between the sides of adjacent pavers, said bed having downward cuts made while the bed is green and made downwardly through said gaps and through any part of said coat in a gap and extending below said gaps to an appreciable depth all around and below the peripheries of the pavers, said cuts tending to confine cracking of said bed, after it has set and been subjected to external stress sufficient to cause said cracking, to cracks which extend downwardly in substantially the vertical direction of said cuts, each parametric continuity of such cracks which extend the full depth of the bed tending to define a fractured-out, monolithic block comprising a whole flawless paver integrated with the part of the setting bed subjacent thereto.

2. An architectural paving system as claimed in claim 1 wherein the thickness of said pavers is between about ⅛ inch and 1-¼ inches and wherein the depth of said cuts as measured from the top of the paver into said bed is not less than about one-third (⅓) the height of the top of the paver above the bottom of the setting bed.

3. An architectural paving system as claimed in claim 1 wherein said bond coat is applied to the whole top surface of said bed and said pavers are laid upon said coat and said cuts are made through said coat and said coat is extruded upwardly around the lower edges of said pavers when said cuts are made.

4. An architectural paving system as claimed in claim 1 wherein filler material is disposed in said gaps and said cuts therebelow, said filler material comprising discrete particles with insufficient bonding material to bond the adjacent sides of said pavers and cuts to each other, said discrete particles tending to enter and be bound between fractured-out blocks and between fractured-out blocks and adjacent unfractured parts of the system.

5. The combination of claim 1 wherein one said monolithic block has been fractured-out of said bed and said base has yielded and been altered incident thereto, said one block still having subjacent support from said altered base and having firm supporting lateral engagement with other adjacent parts of said bed or with other adjacent blocks.

6. The method of architectural paving comprising the steps of laying a frangible setting bed over a yieldable base without bonding the bed to the base, bonding thin frangible architectural pavers to said bed before said bed takes an initial set, said bed having greater strength than said pavers, cutting said bed while green around and below the periphery of each of said pavers to an appreciable depth and confining cracking of the bed after it has set to substantially the vertical planes of the periphery of the pavers and thereby preserving the pavers whole and unblemished.

7. The method of making architectural pavement having thin decorative frangible pavers in a top layer and protecting said pavers from fracture, which comprises the steps of laying a wet setting bed upon a yieldable base of limited strength without bonding said bed to said base, bonding pavers on the top of said bed with the pavers spaced from each other by aligned narrow gaps, cutting said bed below said gaps around each paver to an appreciable depth while the bed is green, and exposing the pavement after the setting bed has set to stresses tending to alter said base and fracture said bed and pavers, said cuts confining the fracturing to cracks in said bed which extend downwardly below said gaps, and fracturing-out monolithic blocks comprising whole unblemished pavers integrated with subjacent portions of the setting bed.

* * * * *

UNITED STATES PATENT AND TRADEMARK OFFICE

CERTIFICATE OF CORRECTION

PATENT NO. : 3,969,851

DATED : 20th July 1976

INVENTOR(S) : Daniel C. Whitacre

It is certified that error appears in the above-identified patent and that said Letters Patent are hereby corrected as shown below:

In the ABSTRACT of the invention, second sentence, line 7, beginning with the words," 'Thin' pavers", 1/4 inches should read 1-1/4 inches Signed and Sealed this Twenty-first Day of September 1976

[SEAL]

*Attest:*

RUTH C. MASON
*Attesting Officer*

C. MARSHALL DANN
*Commissioner of Patents and Trademarks*